US006427869B1

(12) United States Patent
Corbett

(10) Patent No.: US 6,427,869 B1
(45) Date of Patent: Aug. 6, 2002

(54) METHOD AND APPARATUS FOR CONTROLLING THE DISCHARGE OF CONCRETE FROM A CONCRETE HOSE

(75) Inventor: Robert H. Corbett, Novato, CA (US)

(73) Assignee: Berkeley Concrete Pumping, a California corporation, Berkeley, CA (US)

( * ) Notice: Subject to any disclaimer, the term of this patent is extended or adjusted under 35 U.S.C. 154(b) by 0 days.

(21) Appl. No.: 09/662,073

(22) Filed: Sep. 14, 2000

(51) Int. Cl.[7] ..... G01F 11/00

(52) U.S. Cl. ..... 222/1; 222/406; 222/408.5; 222/459

(58) Field of Search ..... 222/1, 406, 408.5, 222/459

(56) References Cited

U.S. PATENT DOCUMENTS 2,561,258 A * 7/1951 Wolf et al. ..... 222/406
3,104,037 A * 9/1963 Myrum ..... 222/406
5,383,581 A * 1/1995 LeMarbe et al. ..... 222/459
5,549,222 A * 8/1996 Schroeder ..... 222/459

* cited by examiner

*Primary Examiner*—Joseph A. Kaufman
(74) *Attorney, Agent, or Firm*—Larry D. Johnson; Craig M. Stainbrook; Johnson & Stainbrook, LLP

(57) ABSTRACT

A concrete hose end insert for controlling the discharge of concrete from a concrete hose, having a base member and clamps for securing the insert to a concrete hose end, and having a vertical insert member for positioning within the interior of a concrete hose end. The hose insert momentarily interrupts the concrete free fall, causing the concrete to recombine or partly compact immediately prior to reaching the discharge end of the hose, thereby reducing the velocity of the discharging concrete for more highly controlled placement.

8 Claims, 3 Drawing Sheets

METHOD AND APPARATUS FOR CONTROLLING THE DISCHARGE OF CONCRETE FROM A CONCRETE HOSE

CROSS REFERENCE TO RELATED APPLICATIONS

Not applicable.

BACKGROUND OF THE INVENTION

1. Field of the Invention

The present invention relates generally to devices for placing concrete or other cementitious materials into earth excavations and/or pre-built forms, and more particularly to a concrete hose end insert, and a method of using the same, for slowing the discharge of concrete from a concrete hose end for increased control during placing operations.

2. Discussion of Related Art

The placement of cementitious material in earth excavations or in spaces defined by concrete foundation forms often entails delivering and placing concrete to the defined space through a vertically disposed boom hose. In light construction projects, liquid cementitious material may be pumped through the hose either directly from a concrete mixer or from a standalone pump into which concrete is poured from the truck's rotating drum mixer. However, in heavy construction, concrete is commonly placed into forms or an excavation using a mobile truck having a boom and an extendable flexible hose mounted on a power driven hose reel and directed by a hose boom, as is described, for example, in U.S. Pat. No. 5,256,005 to Beck, III. More commonly, the mobile concrete pumping truck has an extendable boom and an articulating steel boom pipe extending the length of the boom through which the concrete flows. A flexible hose is attached to the end of the steel boom pipe, usually either a single segment of hose 12½ feet in length (3.81 meters) or two 12½ foot hose segments for a total of 25 feet (7.62 meters). The flexible hose hangs vertically so that the end of the hose is directly over the placement site. Ready-mix concrete is pumped through the boom pipe and into the desired space through the end of the flexible hose. Accordingly, in the typical concrete pouring operation using a mobile pumping truck, there is a vertical free fall of concrete of at least 12½ feet (7.62 meters) before the concrete is discharged out the end of the hose. Even with this minimum of free fall the concrete free falls out at a rapid rate making control of delivery difficult and heavily impacting ground and forms. Depending on the layout of the job site, the boom pipe and flexible hose may need to be combined so that there is a much greater distance of concrete free fall before discharge. When the placement space is close to the pumping truck, it may require that the boom be in a generally upright attitude. When a long boom is used for the operation and must be deployed essentially vertically, it is possible that the concrete must fall in excess of 100 feet (30.5 meters) before discharge.

Thus, regardless of the actual free fall immediately before discharge, the velocity of the concrete leaving the hose end is quite high. This cannot be slowed by reducing the pumping rate, for once the concrete begins its free fall down any descending segment of boom pipe and ultimately through the flexible hose, it falls according to the laws of gravity and is slowed only by incidental contact with the sides of the hose and boom pipe. As a result, the concrete drops into its placement site at a high rate of speed and with considerable force. This can damage forms, cause splattering of concrete outside the defined placement space, and cause extensive concrete flow in open footings. The problem applies to concrete of any practicable slump test. It results in wasted concrete and requires costly, time consuming clean up. On occasion it may result in damage to nearby structures. Furthermore, the fluid pressure of the flowing mud makes control of the hose end difficult. Surges during pumping can cause the hose end to whip around dramatically and dangerously.

Devices have been proposed to reduce concrete splashing when the fluid concrete is poured directly from a concrete truck and to foundation forms through a chute positioned at the back of the truck beneath the mixing drum. For example, U.S. Pat. No. 5,868,180 to Hendrickson teaches a concrete form splash funnel for directing the flow of fluid concrete to the form for a concrete wall or a concrete block wall. The funnel is preferably a unitary plastic piece that can be nested with other funnels for easy storage. As noted, however, this device is designed for placement under the end of a discharge chute beneath the rotating drum of a concrete mixing truck. It is not adaptable for use on the end of a boom hose.

Devices have also been proposed to slow the velocity of concrete pouring from a boom hose. For example, a short steel S-pipe coupled to the hose end came into common use in the industry for a brief period. The two 90 degree bends in the pipe successfully slowed the discharge of mud, but the force of the flowing concrete plugging in the S-pipe often caused the pipe to whip around in a violent fashion. Additionally, residual concrete would set in the lower portion of the first bend during breaks in the operation, causing a dangerous backup of concrete when pouring was resumed. The advantages of this device are easily balanced by its disadvantages.

A pin hose manufactured by Putzmeister of Germany met with greater success and had fewer serious disadvantages than the S-pipe. The pin hose comprises a tapered tip having a plurality of inwardly disposed tines, each of said tines fabricated from a flexible polymer.

However, as with the S-pipe, the pin hose frequently retains vestigial concrete when pouring is suspended or halted. If this concrete sets before pouring resumes, the hose can plug and cause a sudden and dangerous discharge of concrete.

As yet there is no known device adapted to control the flow of fluid concrete through a hose by introducing a simple insert within the interior of the hose end.

SUMMARY OF THE INVENTION

The concrete hose end insert of the present invention provides a means to control the velocity of concrete discharged from a concrete hose, and therefore to control the rate of concrete discharge from a hose end. The inventive apparatus comprises an annular base member having a plurality of integrally connected, spaced-apart clamp members positioned around the annulus and adapted for coupling to a concrete hose end. The hose insert includes a vertical insert member having a lip or flange at its upper end. The lip has a hole for the connection of a chain. The clamp members comprise steel posts welded to the outer circumferential surface of the annular base member, and each of the posts has a threaded aperture through which a metal bolt is screwed for adjustably tightening against the exterior circumference of the concrete hose end.

The hose insert causes turbulence in the flow of concrete immediately prior to its discharge from the hose end. The turbulence and the resulting interruption in flow cause the free falling concrete to recombine or compact slightly while still in the hose. When using the inventive apparatus, concrete discharges at a lower velocity and more homogenized state, and therefore causes minimal splattering and is easily controlled in its placement.

A method of using the above-described apparatus is also disclosed, said method directed to controlling the flow rate of concrete from a concrete hose by recompressing and partly compacting the free falling concrete just inside the discharge end of the hose.

DETAILED DESCRIPTION OF A PREFERRED EMBODIMENT

Figure 1:
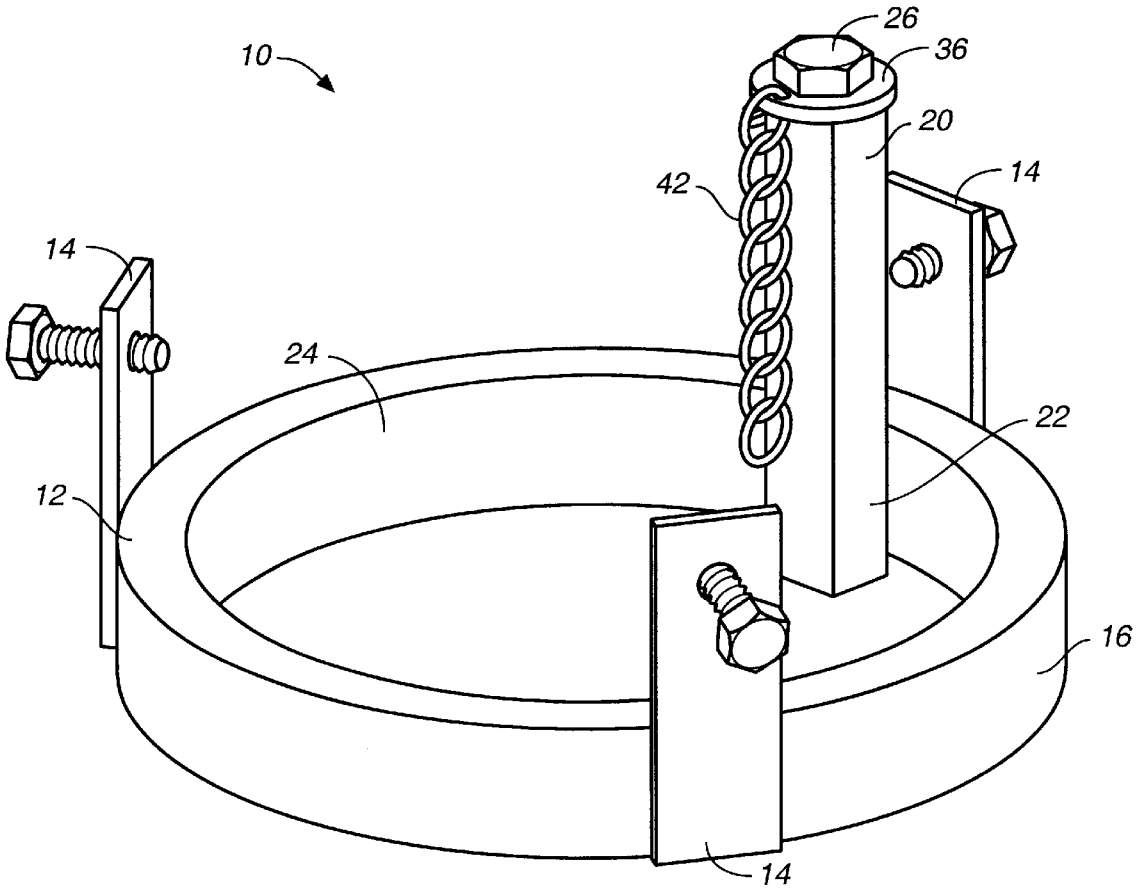
FIG. 1 is a perspective view of a first preferred embodiment of the concrete hose end insert of the present invention.
Figure 2:
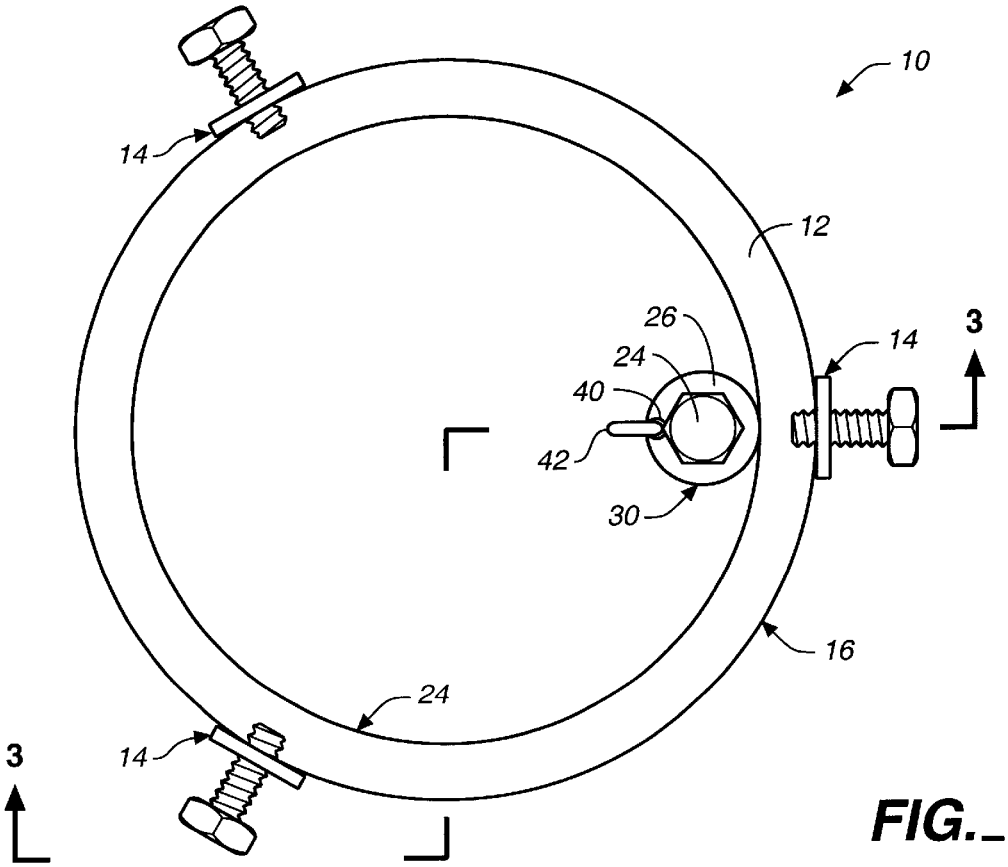
FIG. 2 is a top view of the apparatus of FIG. 1.
Figure 3:
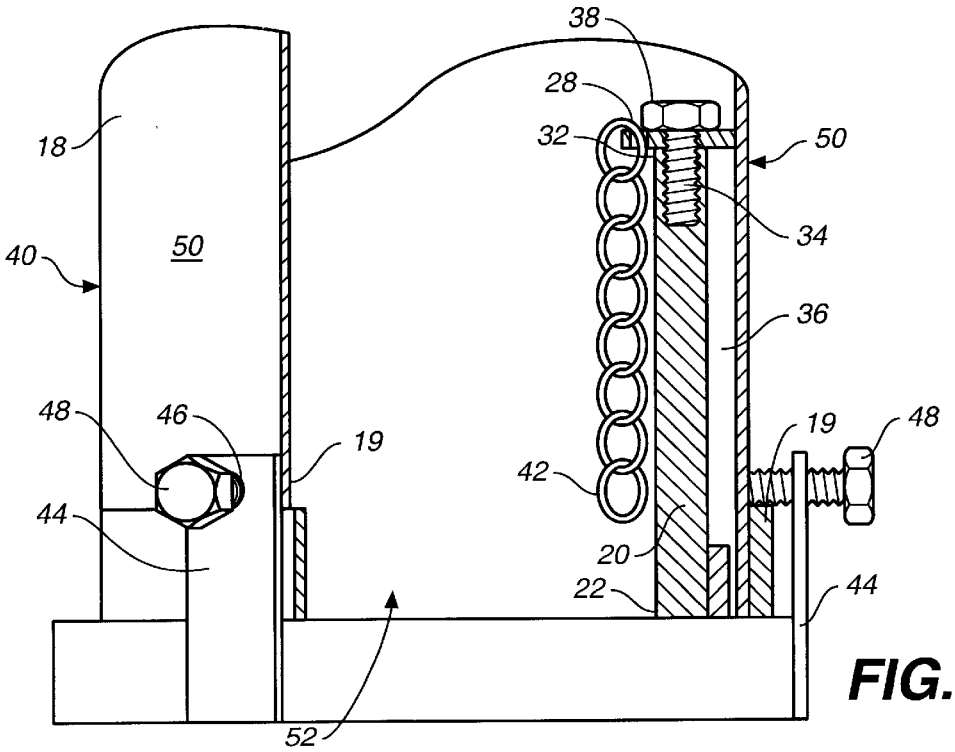
FIG. 3 is a side elevation view of the apparatus of FIGS. 1 and 2, showing a concrete hose end in viewed along the cutting plane shown in FIG. 2, and showing the vertical support member in partial cutaway.

FIG. 1 is a perspective view of the concrete hose end insert 10 of the present invention. FIG. 2 is a top view of the apparatus of FIG. 1, and FIG. 3 is a side elevation view of the apparatus of FIGS. 1 and 2 viewed along the cutting plane defined in FIG. 2. Collectively, these views show that the inventive apparatus comprises an annular base member, or ring 12, having a plurality of spaced-apart clamp members 14 positioned around the outer circumferential surface 16 of the base member and adapted for a leasably coupling to a cylindrical concrete hose end 18 over a hose end collar or ring 19. The inventive apparatus further includes a vertical insert member 20 integrally connected at its lower end 22 to the inner circumferential surface 24 of annular base member 12, said vertical support member extending upwardly from the base member and having a turbulence inducing member, preferably a lip or flange 26, at its upper end. Preferably the turbulence inducing member comprises a washer 28 having a rim with a circumference 30 that extends beyond the upper edges 32, or the transverse cross-sectional area, of vertical insert member 20, a threaded bore hole 34 drilled longitudinally into the upper end 36 of vertical support member 20 into which bolt 38 is threadably inserted to secure washer 28. Washer 28 has a hole 40 for connection of a chain 42 having a plurality of links. It is contemplated that other materials constituting a flexible member may be used instead of chain, such as cable or thick cord. Additionally, the vertical insert member may be capped by any of a number of objects to form an obstruction, preferably ovoid shaped, to the flow of concrete. The object need only be bored with a through hole for connection to the vertical insert member with bolt 38. Thus the size and shape of the obstruction may be carefully tailored to closely match the desired placement characteristics of the concrete.

Moreover, it is contemplated that vertical insert member 20 may be of a variety of shapes, though simple cuboid or cylindrical shapes have proven particularly effective. The size of vertical insert member 20 may also be varied according the particular flow impeding characteristics desired.

The annular base member and connected structures are preferably fabricated from a hardened, corrosion-resistant steel or alloy. Furthermore, clamp members 14 preferably comprise steel posts 44 welded to the upper circumferential surface 16 of the and/or base member 12, each of the posts having a threaded aperture 46 through which a metal bolt 48 is threadably screwed for adjustably tightening against the exterior circumferential surface 50 of the concrete hose end 18.

As concrete passes through hose 18 toward hose end opening 52 it encounters the bolt 38 and washer 28 capping vertical support member 20, and the chain 42 dangling from the washer rim. These elements create a turbulence that effectively interrupts the free fall of concrete through the hose, causing the free falling concrete to momentarily recombine or partly compact within the hose immediately prior to the discharge end. Accordingly, rather than pouring at high velocity in a rapid staccato flowing form, the concrete drops out in a kind of thickened paste from the hose end, not unlike toothpaste being squeezed from a tube. The result is a much more contained flow that eliminates high impact placement. The concrete minimally splatters when it lands in its intended pour space, will not over stress forms, and will not spread uncontrollably from underneath open footings.

Figures 4A, 4B, 4C:
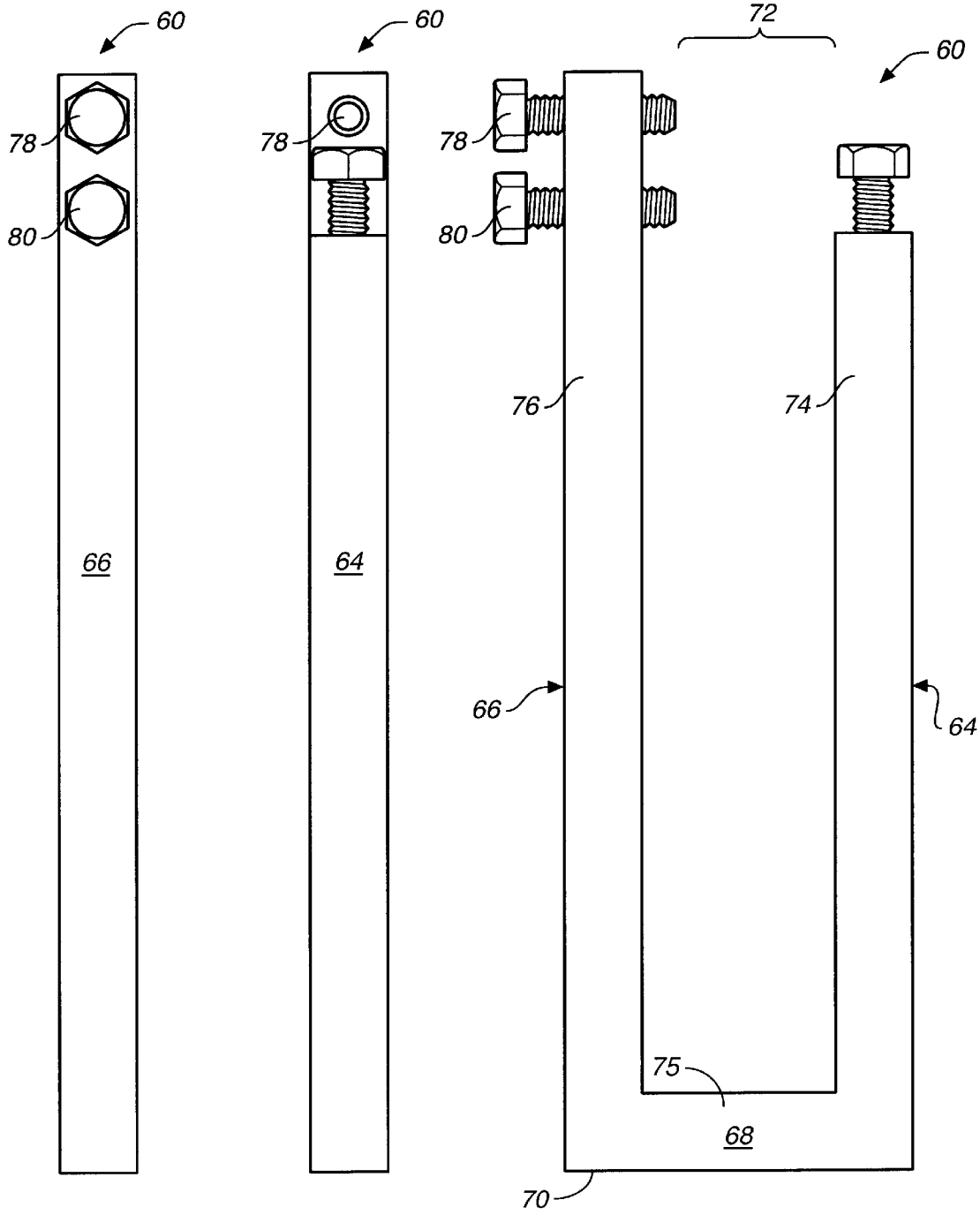
FIG. 4A is a left side elevation view of a second preferred embodiment of the concrete hose insert of the present invention.
FIG. 4B is a right side elevation view of the insert of FIG. 4A.
FIG. 4C is a front elevation view of the second preferred embodiment of the concrete hose insert.

FIG. 4A is a left side elevation view of a second preferred embodiment of the concrete hose insert of the present invention, and FIG. 4B is a right side elevation view thereof. FIG. 4C is a front elevation view of the second preferred embodiment of the concrete hose insert. These views collectively show that the means for fastening or clamping the hose insert to the end of a concrete hose may be significantly more simple than an annular base member having a plurality of clamp members. In this embodiment the hose insert 60 comprises, essentially, a U-shaped bracket 62, preferably asymmetrical, having a right side 64, a left side 66, a back side (not shown), a front side 68, a bottom end 70, and a top end 72, each of the foregoing positional elements defined by a right vertical arm 74 and a left vertical arm 76, each of which are connected, one to the other, by a horizontal base member 75 interposed between the right and left arms, such that the arms are substantially parallel to one another and lie in the same plane. In this embodiment, the right arm 74 functions in the same fashion as the vertical insert member of the above-described first preferred embodiment, and when in use is inserted into the interior of the end of a concrete hose. The left arm 76, preferably slightly longer than the right arm, includes at least one bolt, preferably two, 78, 80, positioned proximate the top end and passing through a threaded hole in the left arm to function as clamp members for tightening against the exterior side of a concrete hose when installed. The right arm (i.e., the vertical insert) includes a vertically disposed bolt inserted into a vertical threaded hole in the top end. As in the first preferred embodiment, a chain, cable or thick cord may be attached to the bolt to induce turbulence and influence the discharge characteristics of the concrete being issuing from the end of the concrete hose.

Considered in its essential terms, the right vertical arm, i.e., the insert or interior arm, may be combined with the second vertical arm, i.e., the exterior arm, configured with a geometry suitable for clamping on to the end of a concrete hose. A U-shaped bracket having exterior clamping bolts serves this purpose with elegant simplicity.

It will be readily appreciated that use of the above-described apparatus constitutes a method of controlling the discharge rate of liquid concrete from a concrete hose. This method comprises the steps of providing an apparatus as described above, inserting the vertical support member into the interior of a concrete hose end, which hose is operatively connected to a pump and a supply of concrete, and securing the apparatus by tightening the clamp members onto the exterior surface of the concrete hose. Pumping of liquid concrete may then proceed in the normal manner.

While this invention has been described in connection with preferred embodiments thereof, it is obvious that modifications and changes therein may be made by those skilled in the art to which it pertains without departing from the spirit and scope of the invention. For example, it is not imperative that the base member be annular, the fundamental principle being adaptability for connection to a hose end. If a concrete hose end were designed and produced in a shape other than cylindrical, it would be obvious to modify the present invention to work with such a design. Accordingly, the scope of this invention is to be limited only by the appended claims.

What is claimed as invention is:

1. A concrete hose end insert for connection to a concrete hose end, comprising:

clamping means for securing said concrete hose insert onto a concrete hose end, said clamping means comprising an annular base member, having an inner circumferential surface and an outer circumferential surface; and a vertical insert member having an upper end and a lower end, said vertical insert member integrally connected at its lower end to said clamping means, said vertical insert member having a longitudinal threaded bore hole at its upper end, wherein said vertical insert member is integrally connected at its lower end to said inner circumferential surface of said annular base member; and a plurality of spaced-apart clamp members positioned around the outer circumferential surface of said annular base member, said clamp members adapted for releasable connection to a concrete hose end, wherein each of said clamp members comprises a vertical post welded to said outer circumference of said annular base member, said vertical post having a threaded aperture, and wherein said apparatus further includes at least one bolt for insertion through the threaded aperture in said vertical post for adjustable tightening of said bolt against the concrete hose end.

2. A concrete hose end insert for connection to a concrete hose end, comprising:

clamping means for securing said concrete hose insert onto a concrete hose end, said clamping means comprising an annular base member, having an inner circumferential surface and an outer circumferential surface; and a vertical insert member having an upper end and a lower end, said vertical insert member integrally connected at its lower end to said clamping means, said vertical insert member having a longitudinal threaded bore hole at its upper end, wherein said vertical insert member is integrally connected at its lower end to said inner circumferential surface of said annular base member wherein said vertical insert member has a threaded bore hole extending downwardly and longitudinally from the upper end of said vertical insert member, and wherein a turbulence inducing member comprises a washer having a circumference exceeding the cross-sectional area of the upper end of said vertical insert member, said washer secured to said upper end of said vertical insert member by a bolt threadably inserted into the bore hole in said vertical insert member; and a plurality of spaced-apart clamp members positioned around the outer circumferential surface of said annular base member, said clamp members adapted for releasable connection to a concrete hostend.

3. A concrete hose end insert for connection to a concrete hose end, comprising:

clamping means for securing said concrete hose insert onto a concrete hose end; and a vertical insert member having an upper end and a lower end, said vertical insert member integrally connected at its lower end to said clamping means, said vertical insert member having a longitudinal threaded bore hole at its upper end; and a turbulence inducing member connected to said upper end of said vertical insert member, wherein said turbulence inducing member includes a chain having at least one link, said chain connected to said bolt inserted into said vertical insert member.

4. A concrete hose end insert for connection to a concrete hose end, comprising:

clamping means for securing said concrete hose insert onto a concrete hose end; and a first vertical insert member having an upper end and a lower end, said vertical insert member integrally connected at its lower end to said clamping means, said vertical insert member having a longitudinal threaded bore hole at its upper end;

wherein said clamping means comprises a second vertical insert member adapted for clamping to the exterior surface of a concrete hose end, said second vertical insert member having at least one threaded hole and at least one bolt passing through said at least one hole for adjustable tightening of said bolt against the concrete hose end.

5. A concrete hose end insert for connection to a concrete hose end, comprising:

a U-shaped bracket having a right vertical arm and a left vertical arm and a horizontal base member interposed between and joining said right and left arms, said left and right arms having a top end and a bottom end, said left arm having at least one threaded hole, said right vertical arm having a vertically disposed threaded hole for insertion of a complementary threaded bolt;

at least one bolt positioned proximate the top end of said left arm and passing through the at least one threaded hole in the left arm, said at least one bolt adapted for tightening against the exterior side of a concrete hose when installed on a hose end;

a vertically disposed bolt inserted into the vertical disposed threaded hole in the top end of said right arm.

6. The concrete hose end insert of claim 5 wherein said U-shaped bracket is asymmetrical.

7. The concrete hose end insert of claim 5 wherein said left vertical arm is longer than said right vertical arm.

8. A method of controlling the discharge of liquid concrete from a concrete hose, said method comprising the steps of:

providing a concrete hose end insert, the insert comprising an annular base member having an inner circum ferential surface and an outer circumferential surface, a plurality of spaced-apart clamp members positioned around the outer circumferential surface of said annular base member, said clamp members adapted for releasable connection to a concrete hose end, a vertical insert member having an upper end and a lower end, said vertical insert member integrally connected at its lower end to said inner circumferential surface of said annular base member, said vertical support member having a longitudinal threaded bore hole at its upper end, an integral lip at said upper end of said vertical insert member; and a flexible member connected to said lip;

inserting the vertical insert member into the opening at the end of a concrete hose; and securing the concrete hose end insert to the concrete hose end by clamping the clamp members to the exterior surface of the concrete hose.

* * * * *